US007724233B2

(12) United States Patent
Lai

(10) Patent No.: US 7,724,233 B2
(45) Date of Patent: May 25, 2010

(54) DRIVING CIRCUIT AND LCD INCORPORATING THE SAME

(75) Inventor: Yi-Chang Lai, Miao-Li (TW)

(73) Assignee: Innolux Display Corp., Miao-Li County (TW)

( * ) Notice: Subject to any disclaimer, the term of this patent is extended or adjusted under 35 U.S.C. 154(b) by 810 days.

(21) Appl. No.: 11/446,804

(22) Filed: Jun. 5, 2006

(65) Prior Publication Data

US 2006/0274025 A1 Dec. 7, 2006

(30) Foreign Application Priority Data

Jun. 3, 2005 (TW) ..... 94118399

(51) Int. Cl.
*G09G 3/36* (2006.01)

(52) U.S. Cl. ..... 345/102; 345/87; 345/204; 345/211; 345/212

(58) Field of Classification Search ..... 345/55, 345/84, 87, 102, 104, 211, 212, 213, 214
See application file for complete search history.

(56) References Cited

U.S. PATENT DOCUMENTS 7,460,103 B2 * 12/2008 Konno et al. ..... 345/102
2002/0101416 A1 8/2002 Woo et al.
2005/0007358 A1 1/2005 Lee
2005/0083294 A1 4/2005 Kim et al.
2006/0097971 A1 * 5/2006 Lee et al. ..... 345/89
2007/0120810 A1 * 5/2007 You et al. ..... 345/103

FOREIGN PATENT DOCUMENTS

CN 1195785 A 10/1998
CN 1359098 A 7/2002
CN 1609941 A 4/2005
EP 0858065 A1 12/1998

* cited by examiner

*Primary Examiner*—My-Chau T Tran
(74) *Attorney, Agent, or Firm*—Wei Te Chung

(57) ABSTRACT

A driving circuit of a liquid crystal display (LCD) (23) includes a system driver (28), a power supply device (26) and a system control device (25). The power supply device provides a votage to the system driver. The system control device generates a control signal, a data signal, and a backlight driving signal, and applies them to the system driver. The system driver drives an LCD panel (21) and a backlight of the LCD according to the backlight driving signal, the data signal and the control signal. The configuration of the driving circuit is simple.

6 Claims, 5 Drawing Sheets

DRIVING CIRCUIT AND LCD INCORPORATING THE SAME

FIELD OF THE INVENTION

The present invention relates to a driving circuit and a liquid crystal display (LCD) having the driving circuit.

GENERAL BACKGROUND

An LCD has the advantages of portability, low power consumption, and low radiation, and has been widely used in various portable information products such as notebooks, personal digital assistants (PDAs), video cameras and the like. Furthermore, the LCD is considered by many to have the potential to completely replace CRT (cathode ray tube) monitors and televisions.

FIG. 3 is a schematic diagram of a typical LCD. The LCD 10 includes an LCD panel 11, a backlight 12 for projecting light to the LCD panel 11, and an LCD driving circuit 13. The LCD panel 11 includes a display area 114 for displaying images, and a periphery circuit area 116. The LCD driving circuit 13 includes a backlight driving circuit 17, a panel driving circuit 18 positioned on the periphery circuit area 116, a power supply device 16, and a system control device 15.

The power supply device 16 provides a voltage to drive the backlight driving circuit 17 and the panel driving circuit 18. The system control device 15 provides a backlight driving signal to the backlight driving circuit 17, and a control signal and a data signal to the panel driving circuit 18. The panel driving circuit 18 drives the LCD panel 11 to display images on the display area 114 according to the control signal and the data signal. The backlight driving circuit 17 drives the backlight 12 according to the backlight driving signal.

FIG. 4 is a block diagram of the panel driving circuit 18. The panel driving circuit 18 includes a gate driver 184, a source driver 183, a latch circuit 182, a gamma adjustment and grayscale voltage generation circuit 187, a regulator circuit 186, a first booster circuit 185, and a panel interface circuit 181. The panel driving circuit 18 is an integrated circuit.

The first booster circuit 185 receives the voltage from the power supply device 16 and drives the gate driver 184 and the regulator circuit 186. The regulator circuit 186 supplies driving voltages to the gate driver 184, the source driver 183, the latch circuit 182, and the gamma adjustment and grayscale voltage generation circuit 187. The panel interface circuit 181 receives the control signal and the data signal from the system control device 15, and provides them to the gate driver 184, the first booster circuit 185, the regulator circuit 186, the latch circuit 182, and the gamma adjustment and grayscale voltage generation circuit 187. The latch circuit 182 and the gamma adjustment and grayscale voltage generation circuit 187 are used to drive the source driver 183 according to the control signal and the data signal. The gate driver 184 is used to scan the LCD panel 11 according to the control signal and the data signal. The source driver 183 provides a plurality of grayscale voltages to the LCD panel 11 when the display area 114 is scanned by the gate driver 184.

FIG. 5 is a block diagram of the backlight driving circuit 17. The backlight driving circuit 17 includes a backlight interface circuit 171, a second booster circuit 172, and an analog/digital transform circuit 173.

The second booster circuit 172 receives the voltage from the power supply device 16 and drives the analog/digital transform circuit 173. The backlight interface circuit 171 receives the backlight driving signal from the system control device 15, and provides it to the second booster circuit 172 and the analog/digital transform circuit 173. The analog/digital transform circuit 173 is used to drive the backlight 12 according to the backlight driving signal. The backlight driving circuit 17 is an integrated circuit.

Because both the backlight driving circuit 17 and the panel driving circuit 18 include a booster circuit 172, 185 therein, the layout of conductive lines 161 that are used to supply the electrical power to the backlight driving circuit 17 and the panel driving circuit 18 from the power supply device 16 has a complicated configuration. Furthermore, because both the backlight driving circuit 17 and the panel driving circuit 18 include an interface circuit 171, 181 therein, the lay out of conductive lines 151 that are used to transmit signals also has a complicated configuration too.

It is desired to provide a driving circuit of an LCD which overcomes the above-described deficiencies.

SUMMARY

A driving circuit of an LCD includes a system driver, a power supply device device, and a system control device. The power supply device provides a votage to the system driver. The system control device generates a backlight driving signal, a data signal and a control signal and applies them to the system driver. The system driver drives an LCD panel and a backlight of the LCD according to the backlight driving signal, the data signal and the control signal.

An LCD includes an LCD panel, a backlight, and a driving circuit. The driving circuit includes a system driver, a power supply device, and a system control device. The power supply device provides a votage to the system driver. The system control device generates a backlight driving signal, a data signal and a control signal and applies them to the system driver. The system driver drives the LCD panel and the backlight of the LCD according to the backlight driving signal, the data signal and the control signal.

Advantages and novel features of the above-described circuit will become more apparent from the following detailed description when taken in conjunction with the accompanying drawings.

DETAILED DESCRIPTION OF PREFERRED EMBODIMENTS

Reference will now be made to the drawings to describe the present invention in detail.

Figure 1:
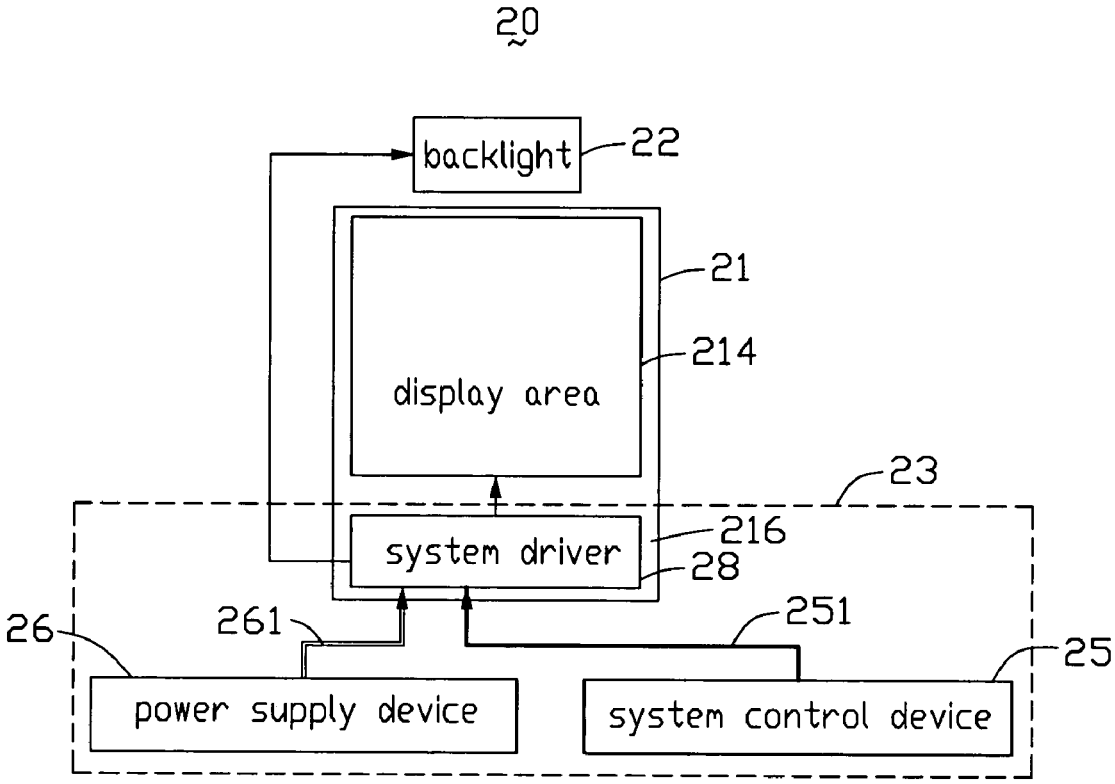
FIG. 1 is a schematic diagram of an LCD having a driving circuit according to a preferred embodiment of the present invention.

FIG. 1 is a schematic diagram of an LCD having a driving circuit according to a preferred embodiment of the present invention. The LCD 20 includes an LCD panel 21, a backlight 22 for projecting light to the LCD panel 21, and a driving circuit 23. The LCD panel 21 includes a display area 214 for displaying images, and a periphery circuit area 216. The driving circuit 23 includes a system driver 28, a power supply device 26, and a system control device 25. The power supply device 26 provides a voltage to the system driver 28. The system control device 25 provides a backlight driving signal, a data signal, and a control signal to the system driver 28. The system driver 28 is positioned on the periphery circuit area 216 for driving the LCD panel 21 to display images on the display area 214 according to the backlight driving signal, the data signal and the control signal. The backlight 22 can be a light emitting diode (LED) or a cold cathode fluorescent lamp (CCLF). The system driver 28 can be an integrated circuit (IC).

Figure 2:
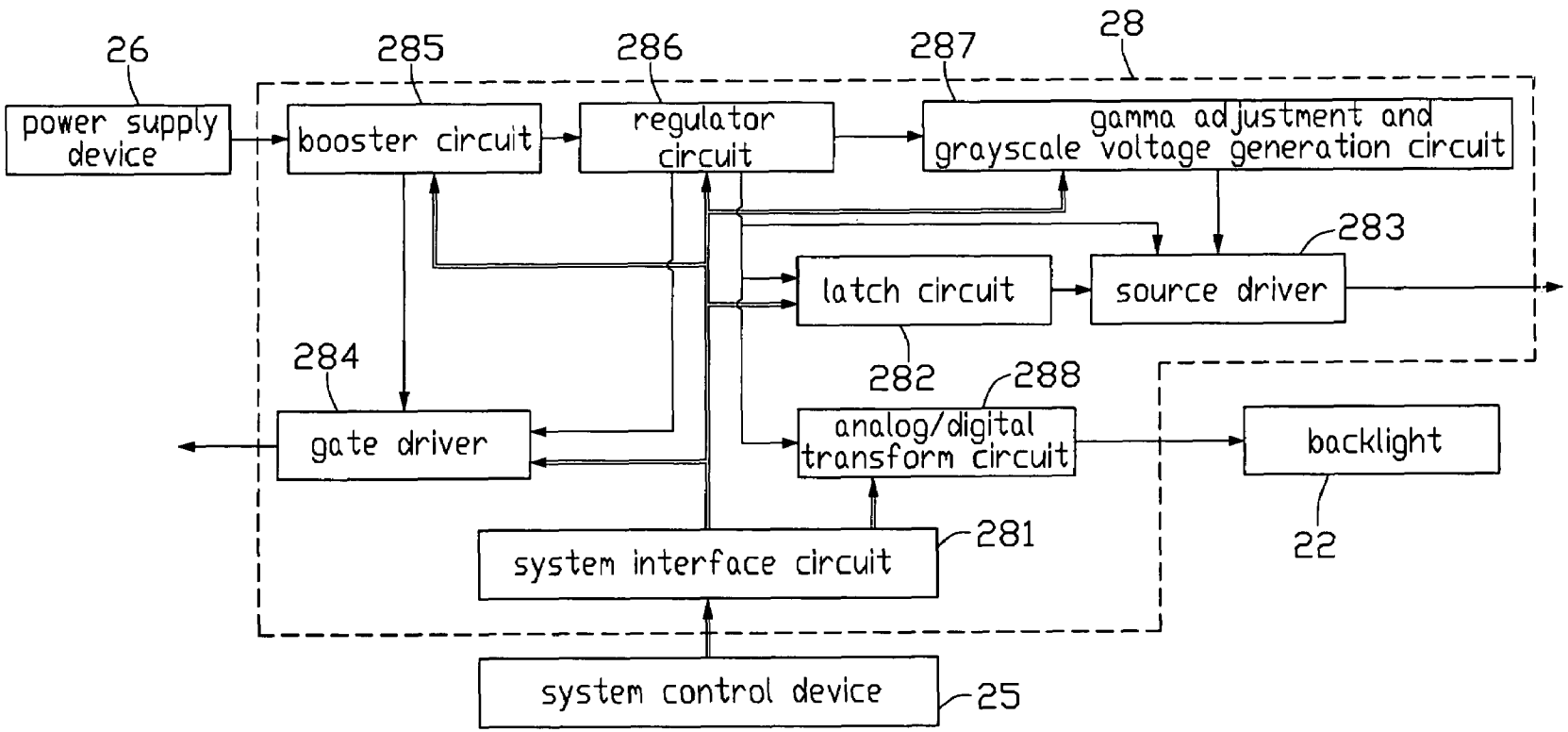
FIG. 2 is a block diagram of a system driver of the driving circuit of FIG. 1, also showing a power supply device and a system control device of the driving circuit.
Figure 3:
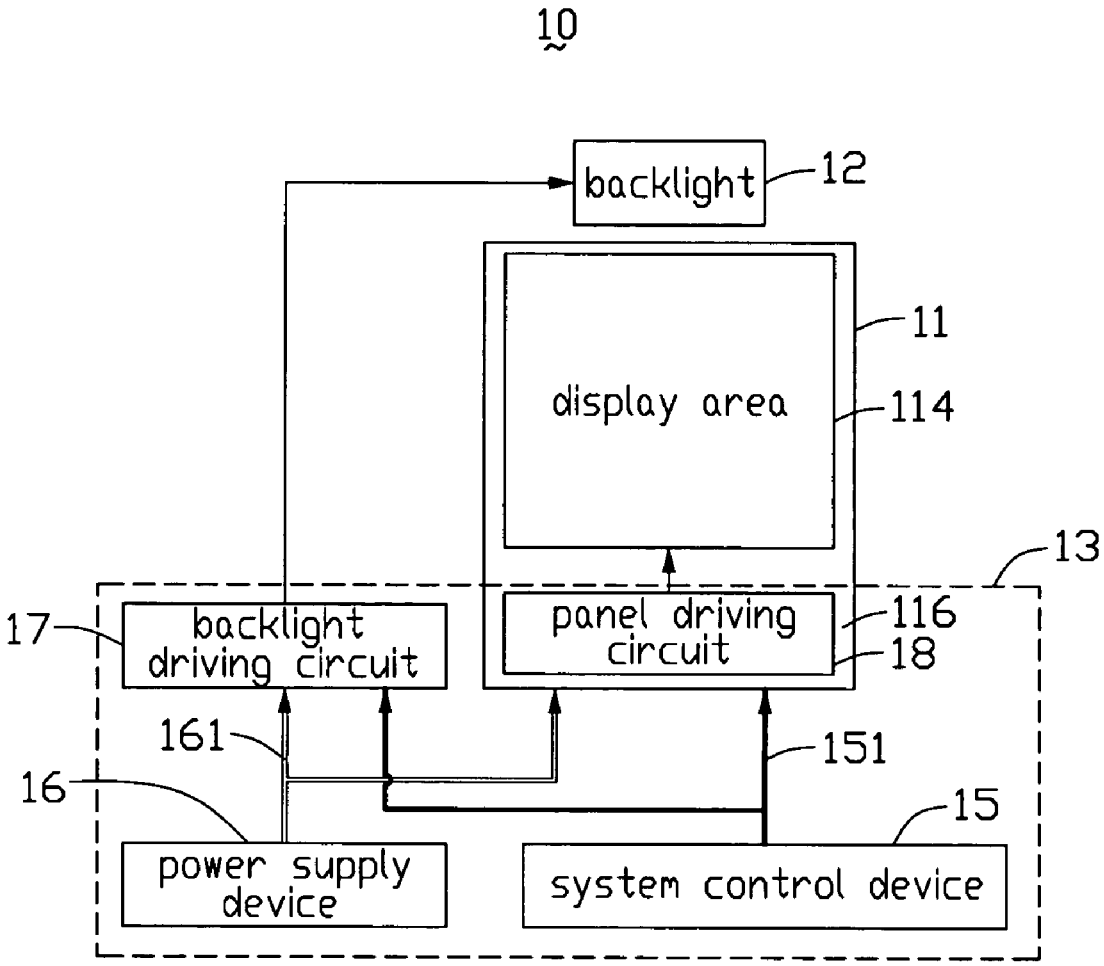
FIG. 3 (RELATED ART)
FIG. 3 is a schematic diagram of a conventional LCD having an LCD driving circuit.
Figure 4:
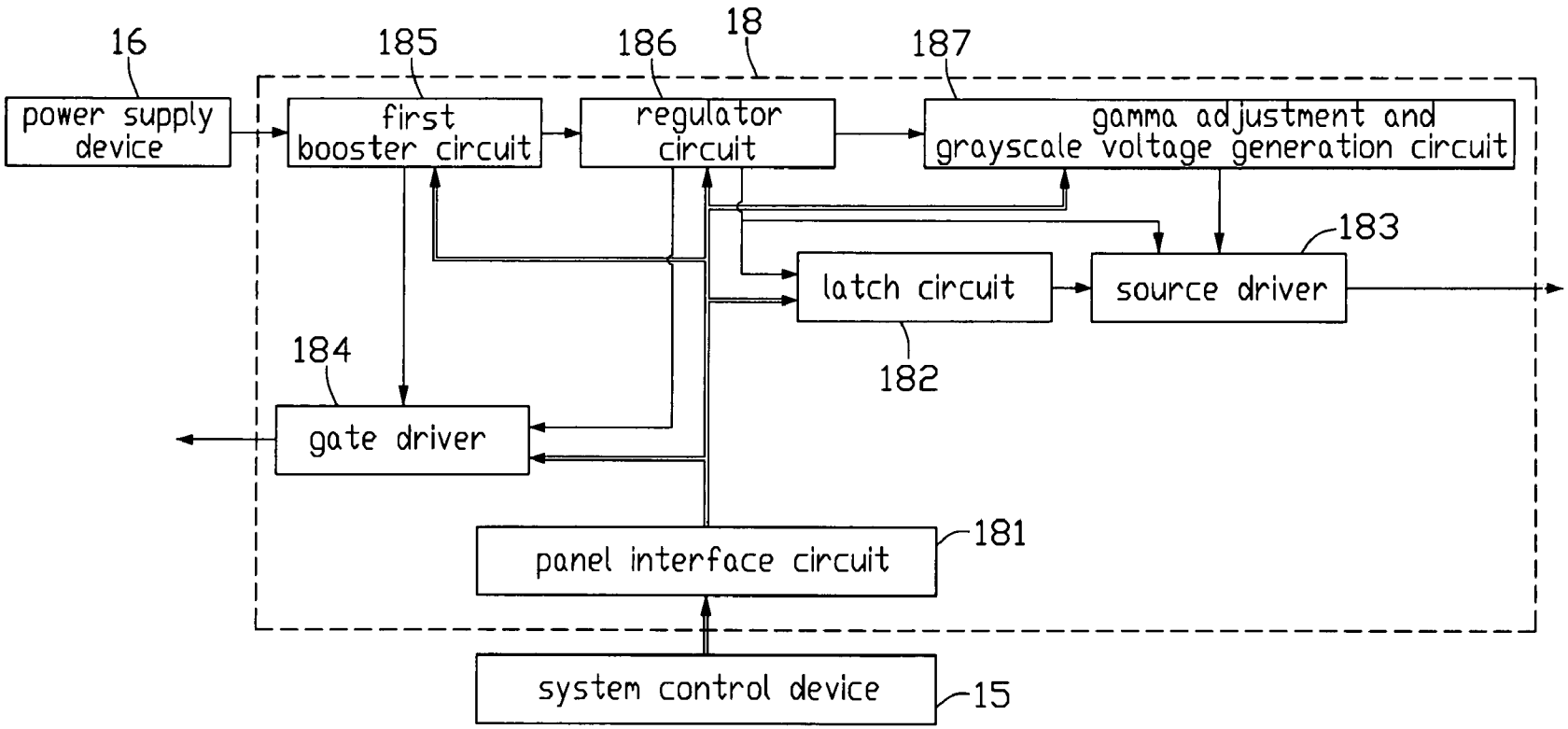
FIG. 4 (RELATED ART)
FIG. 4 is a block diagram of a panel driving circuit of the LCD driving circuit of FIG. 3, also showing a power supply device and a system control device of the LCD driving circuit.
Figure 5:
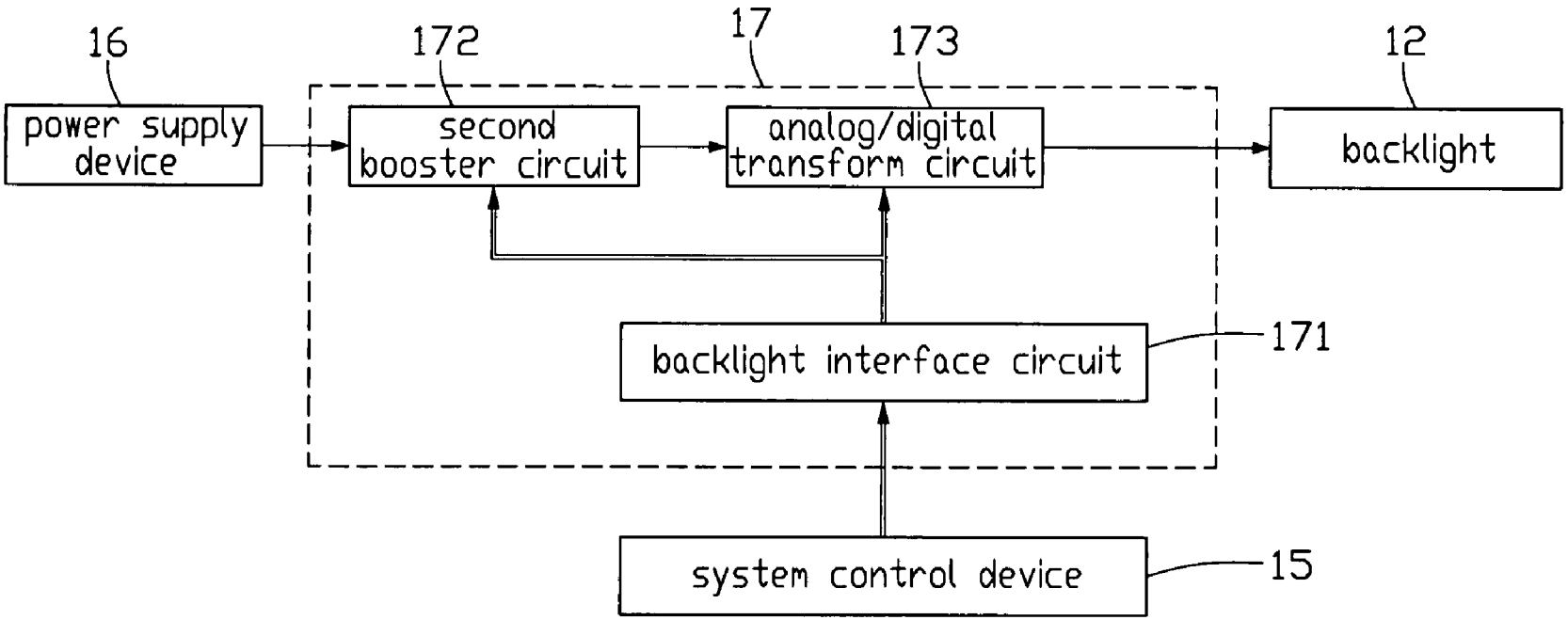
FIG. 5 (RELATED ART)
FIG. 5 is a block diagram of a backlight driving circuit of the LCD driving circuit of FIG. 3, also showing the power supply device and the system control device of the LCD driving circuit.

FIG. 2 is a block diagram of the system driver 28, also showing the power supply device 26 and the system control device 25. The system driver 28 includes a gate driver 284, a source driver 283, a latch circuit 282, a gamma adjustment and grayscale voltage generation circuit 287, a regulator circuit 286, a booster circuit 285, an analog/digital transform circuit 288, and a system interface circuit 281.

The booster circuit 285 receives the voltage from the power supply device 26, and drives the gate driver 284 and the regulator circuit 286. The regulator circuit 286 supplies driving voltages to the gate driver 284, the source driver 283, the latch circuit 282, the gamma adjustment and grayscale voltage generation circuit 287, and the analog/digital transform circuit 288. The system interface circuit 281 receives the control signal and data signal from the system control device 25, and provides them to the gate driver 284, the booster circuit 285, the regulator circuit 286, the latch circuit 282, and the gamma adjustment and grayscale voltage generation circuit 287. The system interface circuit 281 also receives the backlight driving signal from the system control device 25, and provides it to the analog/digital transform circuit 288. The latch circuit 282 and the gamma adjustment and grayscale voltage generation circuit 287 are used to drive the source driver 283 according to the control signal and the data signal. The gate driver 284 is used to scan the LCD panel 21 according to the control signal and the data signal. The source driver 283 provides a plurality of grayscale voltages to the LCD panel 21 when the LCD panel 21 is scanned by the gate driver 284. The analog/digital transform circuit 288 is used to drive the backlight 22 according to the backlight driving signal.

Because the driving circuit 23 only has one booster circuit 285 and one system interface circuit 281, the layout of conductive lines 251, 261 for supplying the electrical power and transmitting signals to the system driver 28 has a relatively simple configuration.

It is to be understood, however, that even though numerous characteristics and advantages of the preferred embodiments have been set out in the foregoing description, together with details of the structures and functions of the embodiments, the disclosure is illustrative only; and that changes may be made in detail, especially in matters of shape, size, and arrangement of parts within the principles of present invention to the full extent indicated by the broad general meaning of the terms in which the appended claims are expressed.

What is claimed is:

1. A driving circuit of a liquid crystal display (LCD), comprising:

a system driver;

a power supply providing a voltage to the system driver; and a control device configured for generating a control signal, a data signal, and a backlight driving signal, and applying the control signal, the data signal and the backlight driving signal to the system driver;

wherein the system driver is configured for driving an LCD panel and a backlight of the LCD according to the control signal, the data signal and the backlight driving signal, the system driver comprising:

a gate driver configured for scanning the LCD panel;

an analog/digital transform circuit configured for driving the backlight;

a regulator circuit configured for supplying voltages to the gate driver and the analog/digital transform circuit;

a booster circuit configured for receiving the voltage from the power supply and driving the gate driver and the regulator circuit; and a system interface circuit configured for receiving the control signal and data signal and providing the control signal and data signal to the gate driver, the booster circuit, and the regulator circuit, and receiving the backlight driving signal and providing the backlight driving signal to the analog/digital transform circuit.

2. The driving circuit as claimed in claim 1, wherein the system driver further comprises:

a source driver configured for providing a plurality of grayscale voltages to the LCD panel;

a gamma adjustment and grayscale voltage generation circuit configured for driving the source driver; and a latch circuit configured for driving the source driver in cooperation with the gamma adjustment and grayscale voltage generation circuit;

wherein the regulator circuit is configured for supplying voltages to the source driver, the latch circuit, and the gamma adjustment and grayscale voltage generation circuit, and the system interface circuit is configured for receiving the control signal and the data signal and providing the control signal and the data signal to the latch circuit and the gamma adjustment and grayscale voltage generation circuit.

3. A liquid crystal display (LCD) comprising an LCD panel, a backlight, and a driving circuit, the driving circuit comprising:

a system driver;

a power supply providing voltage to the system driver; and a control device configured for generating a control signal, the data signal, and a backlight driving signal, and applying the control signal, the data signal and the backlight driving signal to the system driver;

wherein the system driver is configured for driving the LCD panel and the backlight of the LCD according to the control signal, the data signal and the backlight driving signal, the system driver comprising;

a gate driver configured for scanning the LCD panel;

an analog/digital transform circuit configured for driving the backlight;

a regulator circuit configured for supplying voltages to the gate driver and the analog/digital transform circuit;

a booster circuit configured for receiving the voltage from the power supply and driving the gate driver and the regulator circuit; and a system interface circuit configured for receiving the control signal and data signal and providing the control signal and data signal to the gate driver, the booster circuit, and the regulator circuit, and receiving the backlight driving signal and providing the backlight driving signal to the analog/digital transform circuit.

4. The liquid crystal display as claimed in claim 3, wherein the system driver further comprises:

a source driver configured for providing a plurality of grayscale voltages to the LCD panel;

a gamma adjustment and grayscale voltage generation circuit configured for driving the source driver; and a latch circuit configured for driving the source driver in cooperation with the gamma adjustment and grayscale voltage generation circuit;

wherein the regulator circuit is configured for supplying voltages to the source driver, the latch circuit, and the gamma adjustment and grayscale voltage generation circuit, and the system interface circuit is configured for receiving the control signal and the data signal and providing the control signal and the data signal to the latch circuit and the gamma adjustment and grayscale voltage generation circuit.

5. A driving circuit of a liquid crystal display (LCD), comprising:

a system driver;

a power supply providing a voltage to the system driver; and a control device configured for generating a control signal, a data signal, and a backlight driving signal, and applying the control signal, the data signal and the backlight driving signal to the system driver;

wherein the system driver is configured for driving both an LCD panel and a backlight of the LCD by sharing a same booster circuit thereof.

6. The driving circuit of a liquid crystal display (LCD) as claimed in claim 5, wherein the system driver is configured for driving both an LCD panel and a backlight of the LCD by sharing a same regulator circuit thereof.

* * * * *